US008113378B2

(12) United States Patent
Wassmann

(10) Patent No.: US 8,113,378 B2
(45) Date of Patent: Feb. 14, 2012

(54) DRINKING VESSEL

(75) Inventor: Frank Wassmann, Bremen (DE)

(73) Assignee: Bernhard Linnenbaum, Bremen (DE)

( * ) Notice: Subject to any disclaimer, the term of this patent is extended or adjusted under 35 U.S.C. 154(b) by 360 days.

(21) Appl. No.: 11/652,640

(22) Filed: Jan. 12, 2007

(65) Prior Publication Data

US 2007/0164038 A1 Jul. 19, 2007

(30) Foreign Application Priority Data

Jan. 12, 2006 (DE) ..... 20 2006 000 442 U
Mar. 3, 2006 (DE) ..... 20 2006 003 545 U

(51) Int. Cl.
*A47G 19/22* (2006.01)
*B65D 43/16* (2006.01)
*B65D 25/00* (2006.01)

(52) U.S. Cl. ..... 220/703; 215/239; 220/710.5; 220/825; 220/844

(58) Field of Classification Search ..... 220/703, 220/710.5, 730, 735, 736, 756, 744, 825, 220/844, 731, 396, 815, 740; 215/239, 235
See application file for complete search history.

(56) References Cited

U.S. PATENT DOCUMENTS 679,742 A * 8/1901 Goddard ..... 294/31.2
839,977 A * 1/1907 Zimmerman ..... 215/226
1,733,807 A * 10/1929 Landes ..... 215/244
2,315,269 A * 3/1943 Morgillo ..... 248/110
2,489,875 A * 11/1949 Embree ..... 248/113
2,744,631 A * 5/1956 Toombs ..... 210/469
2,786,707 A * 3/1957 Campbell ..... 294/34
2,808,960 A * 10/1957 Wilson ..... 220/736
3,130,856 A * 4/1964 Gits ..... 220/263
3,602,389 A * 8/1971 Russell et al. ..... 220/269
4,020,532 A * 5/1977 Lichter ..... 24/562
4,721,225 A * 1/1988 Sobel ..... 220/736
4,995,526 A * 2/1991 Garrison ..... 220/735
5,702,024 A * 12/1997 Riso ..... 220/704
5,727,712 A * 3/1998 Costello ..... 220/703
5,739,758 A * 4/1998 Driska et al. ..... 340/692
5,853,106 A * 12/1998 Galluzzo ..... 220/731
5,860,558 A * 1/1999 Fahy ..... 220/719
6,318,587 B1 * 11/2001 Friederich ..... 220/845
2003/0173369 A1 * 9/2003 Nikolaus et al. ..... 220/830
2004/0173627 A1 * 9/2004 Kesling ..... 220/756

* cited by examiner

*Primary Examiner* — Mickey Yu
*Assistant Examiner* — Niki M Eloshway
(74) *Attorney, Agent, or Firm* — Browdy and Neimark, PLLC

(57) ABSTRACT

A drinking vessel having a drinking opening bordered by a vessel rim, on which a receptacle element is held so as to be pivotable about a pivot shaft, the receptacle element being displaceable from a first position, in which it is situated in the region of the drinking opening, partially covering the same, into a second position, in which is situated away from the drinking opening, characterized in that the receptacle element is rigidly connected to a pivot element that is supported so as to be pivotable about the pivot shaft.

9 Claims, 4 Drawing Sheets

Figure 1:
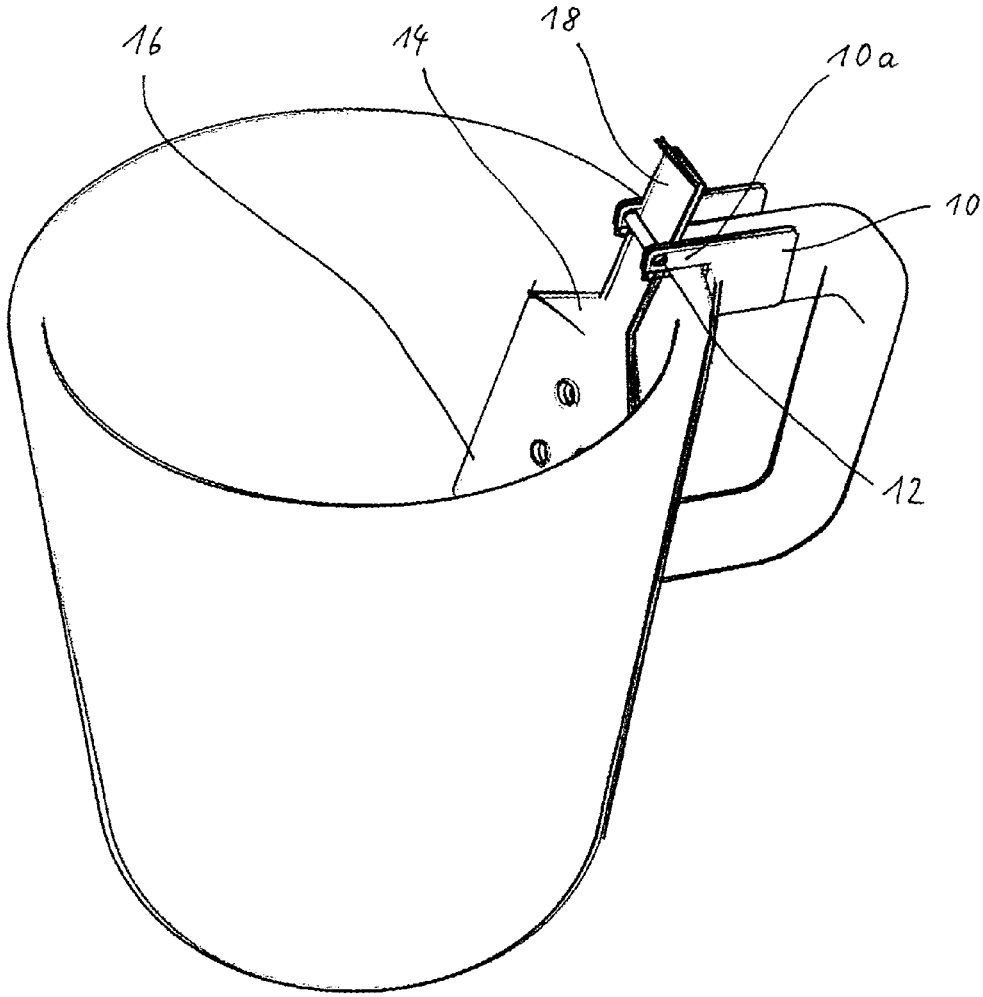

14
26
24
4

14
28
24

2
14
18
4a
18a
12
4
6
16

14
12

DRINKING VESSEL

The present invention is concerned with a drinking vessel having a drinking opening bordered by a vessel rim, on which a receptacle element is held so as to be pivotable about a pivot shaft, the receptacle element being displaceable from a first position, in which it is situated in the region of the drinking opening, partially covering the same, into a second position in which it is situated away from the drinking opening.

In the case of beverages to which certain ingredients must be added more or less immediately prior to their consumption, such as in particular the so-called Feuerzangenbowle ("fire-tongs punch"), where a sugar cone that has been drenched in rum slowly burns above the liquid surface and drips into the drink, it has proven disadvantageous to prepare large quantities in advance, since the flavor and aroma noticeably diminish over time.

From DE 1 902 149 and DE 20 2004 015686, holders that rest atop drinking vessels are known, onto which, for example, a sugar cube may be placed for preparing a "fire-tongs punch". Its manipulation is cumbersome and it is prone to dirtying.

It is the object of the present invention to provide a drinking vessel that makes it possible to prepare smaller quantities of a beverage in a simple manner immediately prior to its consumption.

This object is met according to the invention in a drinking vessel of the generic type through the measure that the receptacle element is rigidly connected to a pivot element that is supported about the pivot shaft, as the result of which it is supported firmly and so as to be pivotable only about the pivot shaft.

Provision may be made for the pivot element to be formed by a continuous bearing shaft or also by two spaced-apart aligned bearing pins that face each other.

In a first embodiment, provision is made for the pivot shaft to be situated in a plane defined by or parallel to the drinking opening.

In another embodiment, provision is made for the pivot shaft to be perpendicular to a plane defined by the drinking opening.

Provision may be made for the receptacle element to extend crosswise to the pivot shaft on both sides and to form a receptacle section and an actuation section.

The receptacle element or receptacle section may be designed flat.

The receptacle element or receptacle section may be designed oblong and dish-like.

In particular, provision may be made for the receptacle element and receptacle section to be designed oblong and V-shaped or tub-shaped in cross-section.

Provision is advantageously made for the receptacle element or receptacle section to have openings.

Provision may be made for the pivot shaft to extend in the region of a handle or through a handle of the drinking vessel.

In the first position, the receptacle element or receptacle section may be disposed in or parallel to a plane defined by the drinking opening.

In the second position, the receptacle element or receptacle section may be situated in a region between a plane defined by the drinking opening and a bottom of the drinking vessel. Provision may be made in this context that the receptacle element or receptacle section in its second position rests against a wall of the drinking vessel.

In one embodiment, provision may be made for the receptacle element or receptacle section in its first position to rest with an end section on the vessel rim opposite the pivot shaft.

In this case the option exists for the pivot shaft to be arranged on an intermediate-lever which, in turn, is held so as to be pivotable on the drinking vessel. Alternatively to an intermediate lever, the receptacle element may have an elongated hole formed in it, which, with the pivot shaft, forms a displaceable and pivotable mounting means for the receptacle element.

Additionally, the option exists that the receptacle element is held on the drinking vessel by means of a ball-and-socket joint.

The invention provides as a preferred variant that the receptacle element is automatically held in its first position by means of a snap-in means that acts particularly in a form-fitting manner.

Alternatively to a snap-in means, provision could be made that the pivot movement of the receptacle element is stiff (high degree of friction), so that, again, an automatic locking in a desired position, particularly in the first position, is ensured.

Alternatively to a snap-in means, provision could be made that the receptacle element can be locked in the first position with the aid of a locking means and can be moved into the second position after releasing the locking means.

In either case, it may be advantageous if a spring means is provided that acts between the drinking vessel and receptacle element and which pre-stresses the receptacle element in the direction toward the first or second position.

The invention additionally relates to a receptacle element having a mounting means pivotably connected to it for mounting to a drinking vessel, whereby an inventive drinking vessel is created. The mounting means may be attachable to a handle or to the vessel rim, and it may preferably be designed as a clamp-type attachment and/or U-shaped. The receptacle element may be designed as explained above and the pivotable connection may also be designed as explained above.

Figure 2:
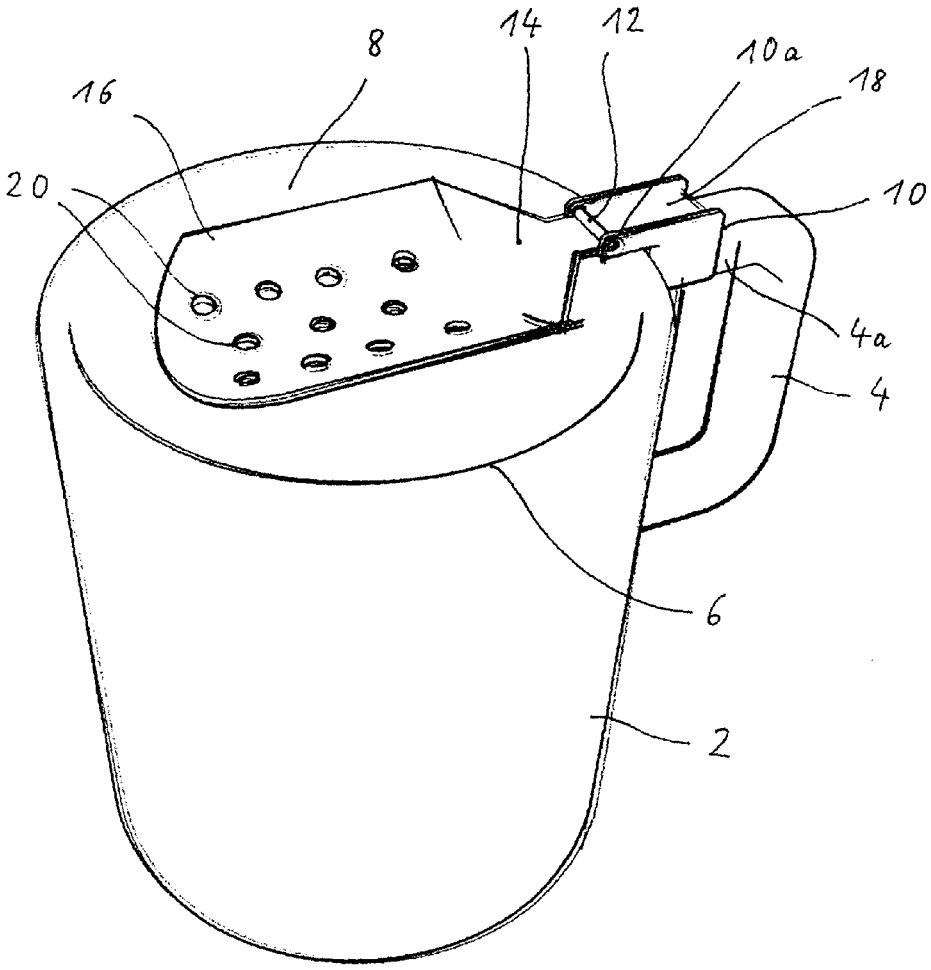
Figure 3:
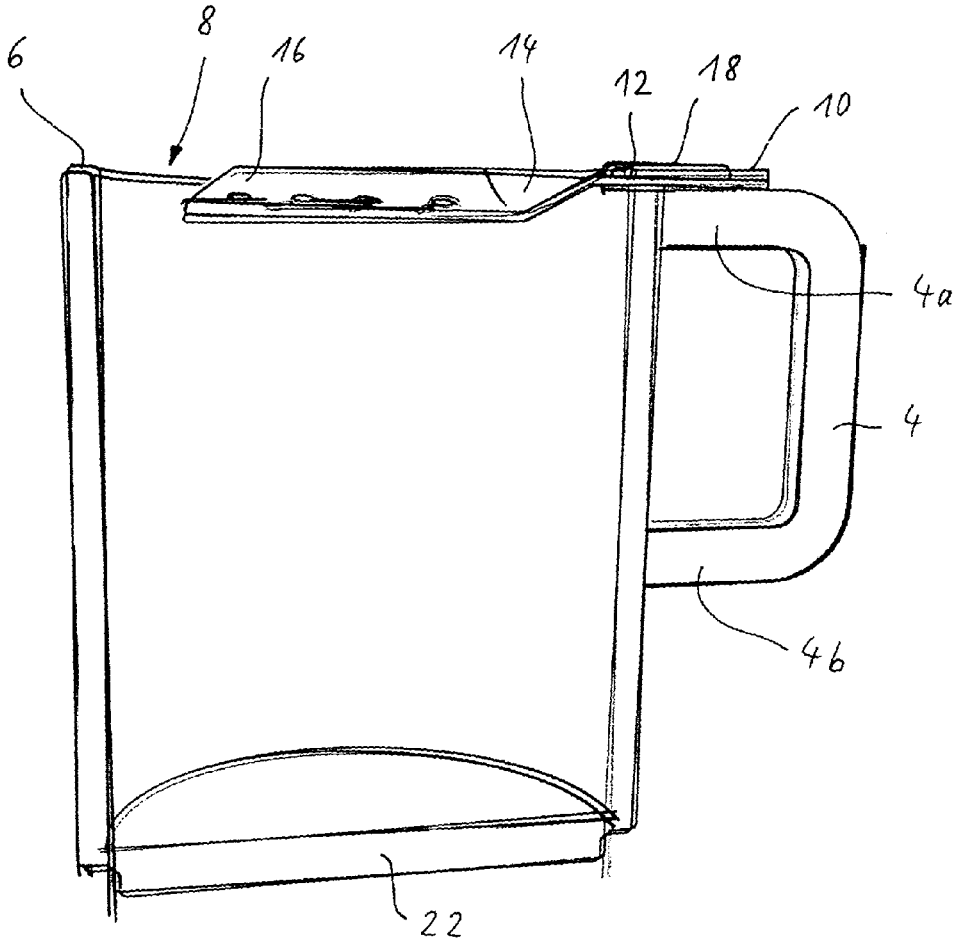
Figures 4, 5, 6, 7:
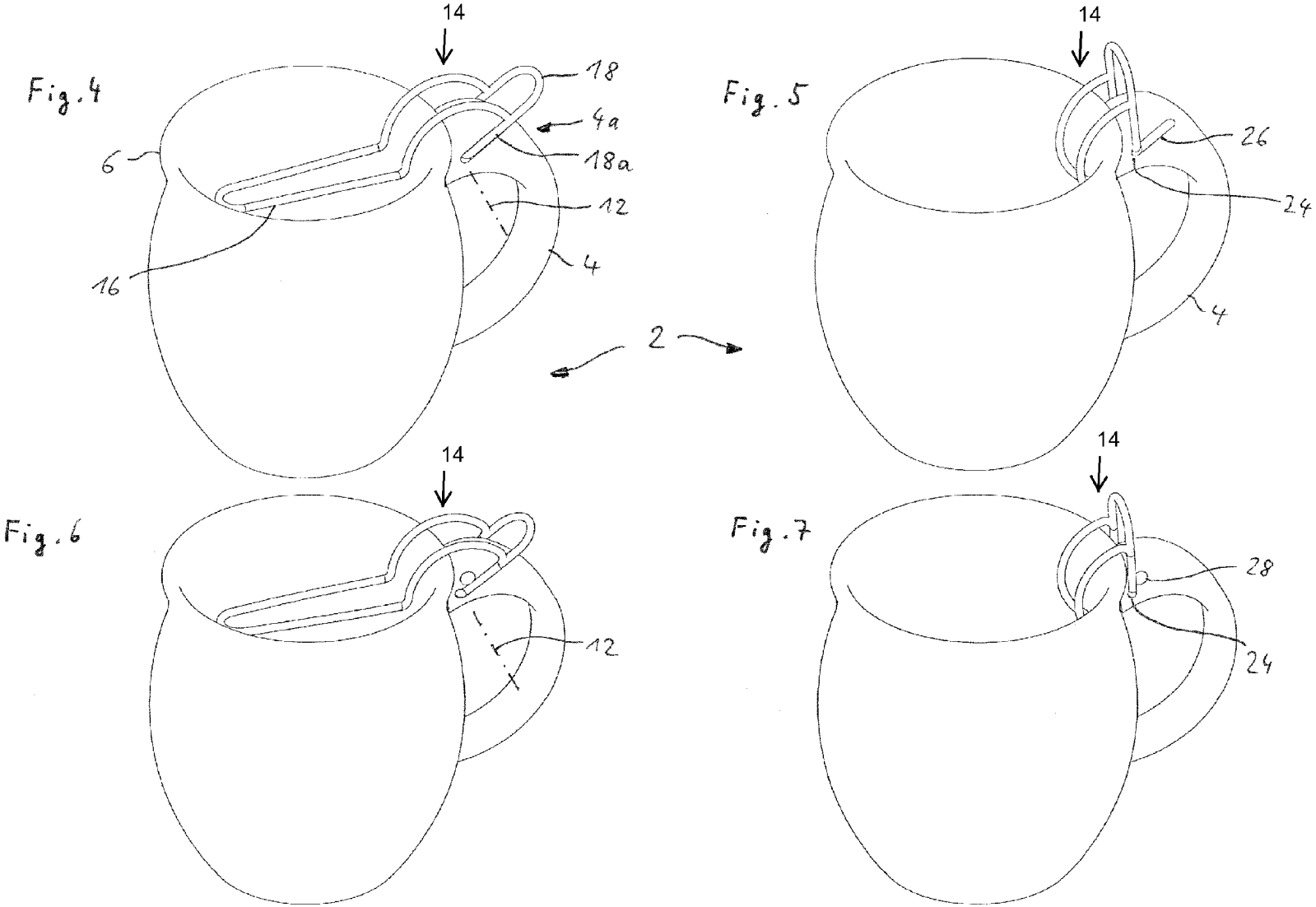

Additional advantages and characteristics of the invention will become apparent from the following description of preferred exemplary embodiments, with reference being made to a drawing in which:

FIG. 1 shows an inventive drinking vessel, the receptacle element being situated in the second position, FIG. 2 shows the drinking vessel of FIG. 1, the receptacle element being situated in the first position, FIG. 3 shows the drinking vessel of FIG. 1 in a longitudinal sectional view, FIGS. 4 and 5 show a second embodiment, and FIGS. 6 and 7 show a third embodiment.

FIG. 1 shows a preferred embodiment of an inventive drinking vessel, which is designed in the form of a mug 2 having a handle 4, with a drinking opening 8 bordered by a circular vessel opening or mug opening 6.

An altogether approximately U-shaped mounting piece 10 hooks around an upper, horizontal handle section **4*a* from underneath and extends inward with elongated leg regions 10*a* beyond the mug rim 6. Fixed to the free ends of the leg regions 10*a* is a pivot shaft 12, which is parallel to the plane of the drinking opening 8 and horizontal when the mug 2 is placed upon a horizontal surface. The pivot shaft 12** is designed either continuous or it consists of two aligned bearing pins facing toward or away from each other, each of them having a free end, that form a pivot element. Conversely, a pivot element could be provided with one or two bearing bores that is/are held so as to be pivotable on a stationary bearing shaft or on two bearing pins, wherein in either case the pivot element is pivotable (only) about a shaft that is stationary relative to the drinking vessel and the receptacle element is rigidly connected to the pivot element.

The pivot shaft 12 has a receptacle element 14 pivotably held on it that incorporates a receptacle section 16 and an actuation section 18. In a first position, which is depicted in FIG. 2, the receptacle section 16 is situated in the region of the drinking opening 8, partially covering the same, while the actuation section 18 is situated in the region of the upper handle section 4*a*. In a second position, which is shown in FIG. 1, and which is pivoted by nearly 90 degrees relative to the first position, the receptacle section 16 rests against the inside wall of the mug 2, while the actuation section 18 is oriented upward.

The receptacle section 16 is designed arched or tub-like crosswise to its longitudinal direction, i.e., viewed in the direction of the pivot shaft 12, and has a series of perforations or openings 20. Alternatively, the receptacle section could also be designed V-shaped or also flat.

In an alternative embodiment, which is not depicted here, provision could be made that the pivot shaft is arranged perpendicular to the orientation depicted in FIGS. 1 through 3 (and perpendicular to the plane of the drinking opening), so that the receptacle element is substantially pivotable in the plane of the drinking opening 8 or parallel thereto.

The receptacle section 16 may lie substantially in one plane with the actuation section 18, as depicted, or the actuation section 18 may be bent at an angle relative to the receptacle section 16, for example by 45° or 90°. Alternatively, the actuation section could be eliminated altogether.

A means is advantageously provided to lock the receptacle element 14 in the first position depicted in FIGS. 2 and 3. In the simplest manner, the pivot shaft 12 could be designed stiffly moving for this purpose, so that the receptacle element is held in its given pivoted position by friction forces alone. It is also possible to have a locking means that holds the receptacle element in the first position. For example, the actuation section 18 could snap into place in a form-fitting manner between the leg regions 10*a* of the mounting element 10 in the first position.

In a variant, the pivot shaft 12, instead of being rigidly fixed to the mug 2, may be hinged to an intermediate lever which, in turn, is held so as to be pivotable, for example, in a lower region 4*b* of the handle 4. The intermediate lever would then extend approximately between the lower region of the handle and the position of the pivot shaft (corresponding to 12) depicted in FIGS. 1 through 3, and allow the pivot shaft 12 to be displaced by a relative short distance substantially horizontally, i.e., in the plane of the drinking opening 8. This would allow the receptacle element 14 to rest, in the first position, on the mug rim opposite the pivot shaft. For transferring into the second position, the pivot shaft of the receptacle element could then be moved back, i.e., in a direction away from the mug, until the receptacle element no longer rests on the mug rim and can be folded into the second position.

Alternatively to an intermediate lever, an elongated hole may be provided in the receptacle element that cooperates with the pivot shaft 12 and, in the first position, allows for a displacement in the plane or parallel to the plane of the drinking opening 8, so that the frontal end of the receptacle element or receptacle section situated away from the pivot shaft can rest on the mug rim opposite the pivot shaft in the first position, and can be moved back for transferring into the second section.

An additional means may be provided to secure the receptacle element in its second position, for example an additional snap-in means or a spring that pre-stresses the receptacle element in the direction toward the second position.

The mounting element 10 may be designed removable from the mug or from the handle section 4*a*, so that an existing mug can be retrofitted with a pivotable receptacle element without difficulty, and/or the same can be removed from it.

In a modification, a hinge or mechanical joint that holds the "fire tongs" is mechanically connected to the cup. The "fire tongs" may be used to hold two sugar cubes, for example. After the sugar has burnt down, the "tongs" fold into the mug (capacity 0.2 liters, for example), without interfering with the consumption.

FIGS. 4 and 5 show an embodiment in which a receptacle element 14 is designed as a wire yoke with a receptacle section 16 and an actuation section 18, each consisting of a wire section that is bent into U-shape. Provided on legs 18*a* of the actuation section 18 are end sections, which are not shown in detail, that are bent at an angle and engage into bearing recesses 24 of the mug 2, acting as bearing pins and defining a pivot shaft 12. Because of the elasticity of the actuation section 18, they and the receptacle element 14 are easy to insert into and remove from the mug 2.

The grip or handle 4 of the mug 2 is provided on one side or on both sides with a snap-in groove 26 (in each case), into which one or both legs 18*a* of the actuation section 18 lock in the first position (FIG. 4), thus securing the receptacle element 14 in this position. After preparation of the beverage has been completed, the receptacle element can be pivoted with one finger under surmounting of the spring effect of the legs 18*a* into the second position shown in FIG. 5.

FIGS. 6 and 7 show a similar embodiment as FIGS. 4 and 5, with only the snap-in groove 26 having been replaced by one or two locking projections 28, over which the actuation section 18 needs to be moved under surmounting of its elastic spring tension, to reach the first or second position. The locking projections 28 may be designed hemispherical, for example.

What is claimed is:

1. A drinking vessel having a drinking opening (8) bordered by a vessel rim (6), on which a receptacle element (14) is held so as to be pivotable about a pivot axis (12), the receptacle element (14) has a receptacle section (16) and an actuation section (18), the receptacle section (16) being displaceable from a horizontal first position, in which it is situated in the region of the drinking opening (8), partially covering the same, into a lowered, downwardly inclined second position, in which the receptacle section is situated below the drinking opening (8) within the vessel and leaves the drinking opening (8) open for drinking, wherein the receptacle element (14) extends crosswise to the pivot axis (12) to both sides, wherein the actuation section (18) of the receptacle element (14) has legs (18*a*), wherein a handle (4) of the drinking vessel is provided on one side with a snap-in groove (26) into which one of the legs (18*a*) of the actuation section (18) locks in the first position, wherein in the second position, the receptacle section (16) rests against a wall of the drinking vessel, and wherein the legs (18*a*) of the actuation section (18) form a pivot element that is supported so as to be pivotable about the pivot axis (12).

2. A drinking vessel according to claim 1, characterized in that the pivot element is formed by a continuous bearing shaft.

3. A drinking vessel according to claim 1, characterized in that the pivot element is formed by two spaced-apart aligned bearing pins that face each other.

4. A drinking vessel according to claim 1, characterized in that the pivot element (12) is situated in a plane parallel to the drinking opening (8).

5. A drinking vessel according to claim 1, characterized in that the pivot element (12) extends in the region of a handle (4) or through a handle (4) of the drinking vessel.

6. A drinking vessel according to claim 1, characterized in that, in the first position, the receptacle element (14) or receptacle section (16) rests with an end section on the vessel rim (6) opposite the pivot element (12).

7. A drinking vessel according to claim 6, characterized in that the pivot element (12) is arranged on an intermediate lever, which, in turn, is supported so as to be pivotable on the drinking vessel.

8. A drinking vessel according to claim 7, characterized in that the receptacle element (14) has an elongated hole formed in it, which, with the pivot shaft (12), forms a displaceable and pivotable mounting means for the receptacle element (14).

9. A drinking vessel having a drinking opening (8) bordered by a vessel rim (6), on which a receptacle element (14) is held so as to be pivotable about a pivot axis (12), the receptacle element (14) having a receptacle section (16) and an actuation section (18) and the receptacle section (16) being displaceable from a horizontal first position, in which it is situated in the region of the drinking opening (8), partially covering the same, into a lowered, downwardly inclined second position, in which the receptacle section is situated below the drinking opening (8) within the vessel and leaves the drinking opening (8) open for drinking, wherein the receptacle element (14) extends crosswise to the pivot axis (12) to both sides, wherein the actuation section (18) of the receptacle element (14) has legs (18*a*), wherein a handle (4) of the drinking vessel is provided on one side with a locking projection (28) over which a leg (18*a*) of the actuation section (18) is elastically moveable to reach the first or second position, wherein in the second position, the receptacle section (16) rests against a wall of the drinking vessel, and wherein the legs (18*a*) of the actuation section (18) form a pivot element that is supported so as to be pivotable about the pivot axis (12).

* * * * *